US006949150B2

(12) United States Patent
Sugawara et al.

(10) Patent No.: US 6,949,150 B2
(45) **Date of Patent: *Sep. 27, 2005**

(54) CONNECTOR COPPER ALLOYS AND A PROCESS FOR PRODUCING THE SAME

(75) Inventors: Akira Sugawara, Iwata-gun (JP); Kazuki Hatakeyama, Iwata-gun (JP); Le Ling, Iwata-gun (JP)

(73) Assignee: Dowa Mining Co., Ltd., Tokyo (JP)

( * ) Notice: Subject to any disclaimer, the term of this patent is extended or adjusted under 35 U.S.C. 154(b) by 164 days.

This patent is subject to a terminal disclaimer.

(21) Appl. No.: 10/252,770

(22) Filed: Sep. 23, 2002

(65) Prior Publication Data

US 2003/0129076 A1 Jul. 10, 2003

Related U.S. Application Data

(63) Continuation-in-part of application No. 09/663,988, filed on Sep. 18, 2000, now abandoned.

(30) Foreign Application Priority Data

Apr. 14, 2000 (JP) ..... 2000-113520

(51) Int. Cl.[7] ..... C22C 9/00

(52) U.S. Cl. ..... 148/432; 148/433; 148/434; 148/435; 148/436

(58) Field of Search ..... 148/432, 433, 148/434, 435, 436

(56) References Cited

U.S. PATENT DOCUMENTS 4,205,984 A 6/1980 Smith, Jr. et al.
6,132,528 A 10/2000 Brauer et al.
6,627,011 B2 9/2003 Sugawara et al.
6,699,337 B2 * 3/2004 Hatakeyama et al. ..... 148/433
2004/0140022 A1 * 7/2004 Inohana et al. ..... 148/553

FOREIGN PATENT DOCUMENTS

| | | |
|---|---|---|
| DE | 2951768 | 7/1981 |
| JP | 62-146230 | 6/1987 |
| JP | 62-227071 | 10/1987 |
| JP | 62-243750 | 10/1987 |
| JP | 10-195562 A | 7/1998 |

* cited by examiner

*Primary Examiner*—Sikyin Ip
(74) *Attorney, Agent, or Firm*—Frishauf, Holtz, Goodman & Chick, P.C.

(57) ABSTRACT

Copper alloy having the basic composition Cu—Zn—Sn contains 23–28 wt % Zn and 0.3–1.8 wt % Sn and satisfies the relation $6.0 \leqq 0.25X+Y \leqq 8.5$ (where X is the addition of Zn in wt % and Y is the addition of Sn in wt %). The alloy is cast into an ingot by melting and cooling over the range from the liquidus line to 600° C. at a rate of at least 50° C./min; the ingot is hot rolled at a temperature not higher than 900° C. and then subjected to repeated cycles of cold rolling and annealing at 300–650° C. to control the size of crystal grains, thereby producing a rolled strip having a 0.2% yield strength of at least 600 N/mm$^2$, a tensile strength of at least 650 N/mm$^2$, an electrical conductivity of at least 20% IACS, a Young's modulus of no more than 120 kN/mm$^2$ and a percent stress relaxation of no more than 20%.

15 Claims, No Drawings

CONNECTOR COPPER ALLOYS AND A PROCESS FOR PRODUCING THE SAME

CROSS REFERENCE TO RELATED APPLICATION

This patent application is a continuation in part application of U.S. patent application Ser. No. 09/663,988 (now abandoned) entitled "Connector Copper Alloys and a Process for Producing the Same" by Sugawara et al. that was filed on Sep. 18, 2000, the entire contents of which are hereby incorporated by reference herein.

BACKGROUND OF THE INVENTION

This invention relates to copper alloys having satisfactory strength, electrical conductivity and stress relaxation characteristics that are suitable for use as materials for connectors and other electrical or electronic components, as well as small Young's modulus.

With the recent advances in electronics, the wire harnessing in various machines has increased in the degree of complexity and integration and this in turn has led to the growth of wrought copper materials for use in connectors and other electrical or electronic components.

The demands required of materials for connectors and other electrical or electronic components include lightweightness, high reliability and low cost. To meet these requirements, copper alloy materials for connectors are becoming smaller in thickness and in order to press them into complex shapes, they must have high strength and elasticity, as well as good electrical conductivity and press formability.

Specifically, electrical terminals must have sufficient strength that they will not buckle or deform during connection and disconnection or upon bending, as well as sufficient strength to withstand caulking of electrical wires and connector fitting followed by holding in position. To meet this need, electrical materials for use as terminals are required to have a 0.2% yield strength of at least 600 N/mm$^2$, preferably at least 650 N/mm$^2$, more preferably at least 700 N/mm$^2$, and a tensile strength of at least 650 N/mm$^2$, preferably at least 700 N/mm$^2$, more preferably at least 750 N/mm$^2$. In addition, in order to prevent chain transfer of deterioration that may occur during pressing, terminals must have sufficient strength in a direction perpendicular to that of working operations such as rolling. To meet this need, electrical materials for use as terminals are required to have a 0.2% yield strength of at least 650 N/mm$^2$, preferably at least 700 N/mm$^2$, more preferably at least 750 N/mm$^2$ and a tensile strength of at least 700 N/mm$^2$, preferably at least 750 N/mm$^2$, more preferably at least 800 N/mm$^2$, in the perpendicular direction.

Further, in order to suppress the generation of Joule's heat due to current impression, electrical materials for use as terminals preferably have a conductivity of at least 20% IACS. Another requirement is that the materials have great enough Young's modulus to ensure that connectors of small size can produce great stress in response to small displacement but this has increased rather than reduced the production cost of terminals because the need for closer dimensional tolerances has required rigorous control not only in mold technology and pressing operations but also over variations in the thickness of strip materials to be worked upon as well as the residual stress that develops in them. Under these circumstances, it has become necessary to design a structure that uses a strip material of small Young's modulus and which undergoes a large enough displacement to allow for substantial dimensional variations. To meet this need, electrical materials for use as terminals are required to have a Young's modulus of 120 kN/mm$^2$ or less, preferably 115 kN/mm$^2$ or less, in the direction where they were wrought and a Young's modulus of 130 kN/mm$^2$ or less, preferably 125 kN/mm$^2$ or less, more preferably 120 kN/mm$^2$ or less in the perpendicular direction.

The above situation has become complicated by the fact that the frequency of mold maintenance accounts for a substantial portion of the production cost. One of the major causes of mold maintenance is worn mold tools. Since mold tools such as punches, dies and strippers wear as a result of repeated punching, bending or other press working operations, burring and dimensional inaccuracy will occur in the workpiece. The effect of the material itself on the wear of mold tools is by no means negligible and there is a growing need to reduce the likelihood of the material for causing mold wear.

Connectors are required to have high resistance to corrosion and resistance to stress corrosion cracking. Since female terminals are subject to thermal loading, they must also have good anti-stress relaxation characteristics. Specifically, their stress corrosion cracking life must be at least three times as long as the value for the conventional class 1 (specified by Japanese Industrial Standard, or JIS) brass and their percent stress relaxation at 150° C. must be no more than one half the value for the class 1 brass, typically 25% or less, preferably 20% or less and more preferably 15% or less.

Brasses and phosphor bronzes have heretofore been used as connector materials. The lower-cost brass, even if its temper grade is H08 (spring), has a yield strength (proof stress) and a tensile strength of about 570 N/mm$^2$ and 640 N/mm$^2$, respectively, thus failing to satisfy the above-mentioned minimum requirements for yield strength (≧600 N/mm$^2$) and tensile strength (≧650 N/mm$^2$). Brass is also poor not only in resistance to corrosion, resistance to stress corrosion cracking, but also in anti-stress relaxation characteristics. Phosphor bronze has good balance between strength, resistance to corrosion, resistance to stress corrosion cracking, and anti-stress relaxation characteristics; on the other hand, the electrical conductivity of phosphor bronze is small (12% IACS for spring phosphor bronze) and an economic disadvantage also results.

Many copper alloys have been developed and proposed to date with a view to solving the aforementioned problems. Most of them have various elements added in small amounts such that they keep in a balance between important characteristics such as strength, electrical conductivity and stress relaxation. However, their Young's modulus was as high as 120–135 kN/mm$^2$ in the direction where the alloy was wrought and in the range of 125–145 kN/mm$^2$ in the perpendicular direction. In addition, their cost was high.

Under these circumstances, researchers are most recently having a new look at brass and phosphor bronze because they both have small enough Young's moduli (110–120 kN/mm$^2$ in the direction where the alloy is wrought and 115–130 kN/mm$^2$ in the perpendicular direction) to meet the aforementioned design criteria. Thus, it is desired to develop a copper alloy that is available at a comparable price to brasses and which exhibits a 0.2% yield strength of at least 600 N/mm$^2$, a tensile strength of at least 650 N/mm$^2$, a Young's modulus of no more than 120 kN/mm$^2$, an electrical conductivity of at least 20% IACS and a percent stress relaxation of no more than 20% in the direction in which the alloy is wrought while exhibiting a 0.2% yield strength of at least 650 N/mm$^2$, a tensile strength of at least 700 N/mm$^2$ and a Young's modulus of no more than 130 kN/mm$^2$ in the perpendicular direction.

Connector materials are given Sn plating in an increasing number of occasions and the usefulness of alloys is enhanced by incorporating Sn. Inclusion of Zn as in brasses increases the ease with which to produce alloys having a good balance between strength, workability and cost. From this viewpoint, Cu—Zn—Sn alloys may well be worth attention and known examples are copper alloys having designations ranging from C40000 to C49900 that are specified by the CDA (Copper Development Association), U.S.A. For example, C42500 is a Cu-9.5Zn-2.0Sn-0.2P alloy and well known as a connector material. C43400 is a Cu-14Zn-0.7Sn alloy and used in switches, relays and terminals, though in small amounts. However, little use as connector materials is made of Cu—Zn—Sn alloys having higher Zn contents. In other words, increased Zn and Sn contents lower hot workability and unless thermo-mechanical treatments are properly controlled, various characteristics such as the mechanical ones desired for the connector materials cannot be developed and, what is more, nothing has been known about the appropriate Zn and Sn contents and the conditions for producing the desired connector materials.

Specific examples of copper alloys containing more Zn than C42500 include C43500 (Cu-18Zn-0.9Sn), C44500 (Cu-28Zn-1Sn-0.05P) and C46700 (Cu-39Zn-0.8Sn-0.05P) and they are fabricated into sheets, rods, tubes and other shapes that only find use in musical instruments, ships and miscellaneous goods but not as wrought materials for connectors, particularly as strips. Even these materials fail to satisfy all requirements for connector materials, representative examples of which are as follows:

(1) that they have a 0.2% yield strength of at least 600 N/mm$^2$, a tensile strength of at least 650 N/mm$^2$, a Young's modulus of no more than 120 kN/mm$^2$, an electrical conductivity of at least 20% IACS and a percent stress relaxation of no more than 20% in the direction where the alloy was wrought;

(2) that they have a 0.2% yield strength of at least 650 N/mm$^2$, a tensile strength of at least 700 N/mm$^2$ and a Young's modulus of no more than 130 kN/mm$^2$ in a direction perpendicular to the one where the alloy was wrought;

(3) that they have good press formability; and (4) that they have high resistance to stress corrosion cracking.

SUMMARY OF THE INVENTION

The present invention has been accomplished under these circumstances and has as an object providing a copper alloy for use as connectors that can be manufactured at low cost and which exhibits good performance in 0.2% yield strength, tensile strength, electrical conductivity, Young's modulus, anti-stress relaxation characteristics, press formability and any other qualities that are currently required of materials for connectors and other electrical or electronic components in view of the recent advances in electronics.

Another object of the invention is to provide a process for producing such connector copper alloys.

As a result of the intensive studies they made in order to attain the above-stated objects, the present inventors found optimum proportions of Zn and Sn in the Cu—Zn—Sn alloy that could simultaneously satisfy the above-mentioned characteristics required of materials for connectors and other electrical or electronic components. At the same time, they found that in order to implement those characteristics, the relationship between the conditions for cooling ingots and rolling them and the conditions for subsequent heat treatments was extremely important. Based on this finding, the present inventors set the optimum processing and working conditions, eventually accomplishing the present invention.

Thus, according to the first aspect of the invention, there is provided a connector copper alloy that contains 23–28 wt % Zn and 0.3–1.8 wt % Sn while satisfying the following relation (1), with the balance being Cu and incidental impurities:

$$6.0 \leqq 0.25X+Y \leqq 8.5 \quad (1)$$

where X is the addition of Zn (in wt %) and Y is the addition of Sn (in wt %), further characterized in that said alloy has a 0.2% yield strength of at least 600 N/mm$^2$, a tensile strength of at least 650 N/mm$^2$, an electrical conductivity of at least 20% IACS, a Young's modulus of no more than 120 kN/mm$^2$, and a percent stress relaxation of no more than 20%.

According to the first aspect of the invention, there is also provided a connector copper alloy that contains 23–28 wt % Zn and 0.3–1.8 wt % Sn while satisfying the following relation (1), with the balance being Cu and incidental impurities:

$$6.0 \leqq 0.25X+Y \leqq 8.5 \quad (1)$$

where X is the addition of Zn (in wt %) and Y is the addition of Sn (in wt %), further characterized in that said alloy has a 0.2% yield strength of at least 600 N/mm$^2$, a tensile strength of at least 650 N/mm$^2$, a Young's modulus of no more than 120 kN/mm$^2$, an electrical conductivity of at least 20% IACS and a percent stress relaxation of no more than 20% in the direction where said alloy was wrought whereas it has a 0.2% yield strength of at least 650 N/mm$^2$, a tensile strength of at least 700 N/mm$^2$ and a Young's modulus of no more than 130 kN/mm$^2$ in a direction perpendicular to said first direction.

Either of the copper alloys described above may further contain 0.01–0.6 wt % in total of at least one element selected from the group consisting of 0.01–0.6 wt % Ni, 0.01–0.6 wt % Co, 0.01–0.6 wt % Ti, 0.01–0.6 wt % Mg, 0.01–0.6 wt % Zr, 0.01–0.6 wt % Ca, 0.01–0.6 wt % Cd, 0.01–0.6 wt % Al, 0.01–0.6 wt % Pb, 0.01–0.6 wt % Bi, 0.01–0.6 wt % Be, 0.01–0.6 wt % Te, 0.01–0.6 wt % Y, 0.01–0.6 wt % La, 0.01–0.6 wt % Cr, 0.01–0.6 wt % Ce, 0.01–0.6 wt % Au and 0.01–0.6 wt % Ag, provided that S is present in an amount of up to 30 ppm.

According to the second aspect of the invention, there is provided a process for producing a connector copper alloy which comprises the steps of:

melting an alloy that contains 23–28 wt % Zn and 0.3–1.8 wt % Sn while satisfying the following relation (1), with the balance being Cu and incidental impurities:

$$6.0 \leqq 0.25X+Y \leqq 8.5 \quad (1)$$

where X is the addition of Zn (in wt %) and Y is the addition of Sn (in wt %);

cooling the melt from the liquidus line to 600° C. at a rate of at least 50° C./min; and subsequently hot rolling the resulting ingot at an elevated temperature of 900° C. or below.

According to the second aspect of the invention, there is also provided a process for producing a connector copper alloy which comprises the steps of:

melting an alloy that contains 23–28 wt % Zn and 0.3–1.8 wt % Sn while satisfying the following relation (1), with the balance being Cu and incidental impurities:

$$6.0 \leqq 0.25X+Y \leqq 8.5 \quad (1)$$

where X is the addition of Zn (in wt %) and Y is the addition of Sn (in wt %);

cooling the melt from the liquidus line to 600° C. at a rate of at least 50° C./min;

subsequently hot rolling the resulting ingot at an elevated temperature of 900° C. or below; and repeating the process of cold rolling and annealing in a temperature range of 300–650° C. until the as-annealed rolled strip has a crystal grain size of no more than 25 μm.

According to the second aspect of the invention, there is also provided a process for producing a connector copper alloy which comprises the steps of:

melting an alloy that contains 23–28 wt % Zn and 0.3–1.8 wt % Sn while satisfying the following relation (1), with the balance being Cu and incidental impurities:

$$6.0 \leqq 0.25X+Y \leqq 8.5 \quad (1)$$

where X is the addition of Zn (in wt %) and Y is the addition of Sn (in wt %);

cooling the melt from the liquidus line to 600° C. at a rate of at least 50° C./min;

subsequently hot rolling the resulting ingot at an elevated temperature of 900° C. or below;

repeating the process of cold rolling and annealing in a temperature range of 300–650° C. until the as-annealed rolled strip has a crystal grain size of no more than 25 μm; and further performing cold rolling for a reduction ratio of at least 30% and cold annealing at 450° C. or below so that the rolled strip has a 0.2% yield strength of at least 600 N/mm$^2$, a tensile strength of at least 650 N/mm$^2$, a Young's modulus of no more than 120 kN/mm$^2$, an electrical conductivity of at least 20% IACS and a percent stress relaxation of no more than 20% in the direction where said alloy was wrought whereas it has a 0.2% yield strength of at least 650 N/mm$^2$, a tensile strength of at least 700 N/mm$^2$ and a Young's modulus of no more than 130 kN/mm$^2$ in a direction perpendicular to said first direction.

In either of the processes described above, said copper alloy may further contain 0.01–0.6 wt % in total of at least one element selected from the group consisting of 0.01–0.6 wt % Ni, 0.01–0.6 wt % Co, 0.01–0.6 wt % Ti, 0.01–0.6 wt % Mg, 0.01–0.6 wt % Zr, 0.01–0.6 wt % Ca, 0.01–0.6 wt % Cd, 0.01–0.6 wt % Al, 0.01–0.6 wt % Pb, 0.01–0.6 wt % Bi, 0.01–0.6 wt % Be, 0.01–0.6 wt % Te, 0.01–0.6 wt % Y, 0.01–0.6 wt % La, 0.01–0.6 wt % Cr, 0.01–0.6 wt % Ce, 0.01–0.6 wt % Au and 0.01–0.6 wt % Ag, provided that S is present in an amount of up to 30 ppm.

To produce the connector copper alloy of the invention in rolled strip form, a molten copper alloy adjusted to have the desired composition is first poured into a mold, where it is cooled from the liquidus line to 600° C. at a rate of at least 50° C./min to ensure that there will be no segregation of Zn and Sn in the resulting ingot. The ingot is then hot rolled at an elevated temperature not higher than 900° C., say, at about 800° C. and subsequently quenched to produce a hot rolled strip having a homogeneous structure of moderately sized crystal grains. Thereafter, the strip is cold rolled and annealed at a temperature of 300–650° C., with the process of cold rolling and annealing being repeated the necessary times, so that the size of crystal grains in the rolled strip is no more than 25 μm. Preferably, the rolled strip is further subjected to cold rolling for a reduction ratio of at least 30% and low-temperature annealing at 450° C. or below to control the size of the crystal grains so that it has a 0.2% yield strength of at least 600 N/mm$^2$, a tensile strength of at least 650 N/mm$^2$, an electrical conductivity of at least 20% IACS, a Young's modulus of no more than 120 kN/mm$^2$ and a percent stress relaxation of no more than 20% in the direction where it was wrought whereas it has a 0.2% yield strength of at least 650 N/mm$^2$, a tensile strength of at least 700 N/mm$^2$ and a Young's modulus of no more than 130 kN/mm$^2$ in a direction perpendicular to said first direction.

DESCRIPTION OF THE PREFERRED EMBODIMENT

The present invention will now be described in greater detail.

[Criticality of the Proportions of Alloying Elements]

Zn: Zinc (Zn) is desirably added in large amounts since it contributes to enhanced strength and spring quality and is available at a lower price than Cu. If its addition exceeds 28 wt %, extensive intergranular segregation occurs in the presence of Sn, causing significant drop in hot workability. Also unfavorably affected are cold workability and resistance to corrosion, and resistance to stress corrosion cracking. Platability and solderability which are sensitive to moisture and heat are also deteriorated. If the addition of Zn is smaller than 23 wt %, strength and spring quality that are typified by 0.2% yield strength and tensile strength are insufficient and Young's modulus increases. What is more, if scrap that was surface treated with Sn is used as the material to be melted, the resulting melt will occlude an increased amount of hydrogen gas to produce an ingot in which blow holes are highly likely to occur. Since Zn is an inexpensive element, using less than 23 wt % of it is an economical disadvantage. For these reasons, the Zn content is specified to range from 23 to 28 wt %. A preferred range is from 24 to 27 wt %. The small range for the Zn content is one of the basic requirements of the present invention.

Sn: Tin (Sn) has the advantage that it need be used in a very small amount to be effective in improving mechanical characteristics such as strength and elasticity typified by 0.2% yield strength and tensile strength without increasing Young's modulus. Since Sn is an expensive element, materials having a surface Sn coat such as tin plating can be put into a recycle path and this is another reason why incorporating Sn is preferred. However, if the Sn content increases, electrical conductivity drops sharply and extensive intergranular segregation occurs in the presence of Zn, causing significant drop in hot workability. In order to ensure the desired hot workability and an electrical conductivity of at least 20% IACS, the addition of Sn should not exceed 1.8 wt %. If the addition of Sn is less than 0.3 wt %, there will be no improvement in mechanical characteristics and chips or the like that result from the pressing of tin-plated or otherwise tin-coated scrap are difficult to use as the material to be melted. Therefore, the content of Sn is specified to range from 0.3 to 1.8 wt %, preferably from 0.6 to 1.4 wt %.

If Zn and Sn are contained in the amounts specified above and if they satisfy the following relation (1), preferably the following relation (2), the Zn- and Sn-rich phases that precipitate at grain boundaries under high temperature as when casting or hot rolling is performed can be effectively controlled to produce a copper alloy that has a 0.2% yield strength of at least 600 N/mm$^2$, a tensile strength of at least 650 N/mm$^2$, a Young's modulus of no more than 120 kN/mm$^2$, an electrical conductivity of at least 20% IACS and a percent stress relaxation of no more than 20% in the direction where said alloy was wrought, that has a 0.2% yield strength of at least 650 N/mm$^2$, a tensile strength of at least 700 N/mm$^2$ and a Young's modulus of no more than 130 kN/mm$^2$ in a direction perpendicular to said first direction, and that also has the characteristics required for use as connector materials, as exemplified by resistance to corrosion, resistance to stress corrosion cracking (having a cracking life in ammonia vapor which is at least three times the value for class 1 brass), anti-stress relaxation characteristics (the percent stress relaxation at 150° C. being no more than one half the value for class 1 brass and comparable to phosphor bronze), and efficient punching on a press:

$$6.0 \leqq 0.25X+Y \leqq 8.5 \quad (1)$$

$$6.4 \leqq 0.25X+Y \leqq 8.0 \quad (2)$$

where X is the addition of Zn (in wt %) and Y is the addition of Sn (in wt %).

The content of S as an impurity is desirably held to a minimum. Even a small amount of S will markedly reduce the working capacity, or deformability, in hot rolling. Two typical sources for the entrance of S is scrap that has been plated with tin in a sulfate bath and oils for working such as pressing; controlling the value of S content is effective for preventing cracking in the process of hot rolling. In order to have this effect come into being, S should not be present in an amount greater than 30 ppm, preferably no more than 15 ppm.

Besides Zn and Sn, a third alloying element may be added and it is 0.01–0.6 wt % in total of at least one element selected from the group consisting of 0.01–0.6 wt % Ni, 0.01–0.6 wt % Co, 0.01–0.6 wt % Ti, 0.01–0.6 wt % Mg, 0.01–0.6 wt % Zr, 0.01–0.6 wt % Ca, 0.01–0.6 wt % Cd, 0.01–0.6 wt % Al, 0.01–0.6 wt % Pb, 0.01–0.6 wt % Bi, 0.01–0.6 wt % Be, 0.01–0.6 wt % Te, 0.01–0.6 wt % Y, 0.01–0.6 wt % La, 0.01–0.6 wt % Cr, 0.01–0.6 wt % Ce, 0.01–0.6 wt % Au and 0.01–0.6 wt % Ag, provided that S is present in an amount of up to 30 ppm.

These elements can enhance strength without substantial deterioration in electrical conductivity, Young's modulus and machinability. If the ranges for the contents of the respective elements are not observed, the stated effect is not attained or, alternatively, disadvantages will result in various aspects such as hot workability, cold workability, press formability, electrical conductivity, Young's modulus and cost.

[Criticality for Manufacturing Conditions]

The first step in the process of the present invention for producing hot rolled, copper alloy strips is melting the copper alloy of the invention and casting the melt into an ingot. If scrap having a surface Sn coat, in particular chips resulting from punching on a press, are to be melted, a preliminary heat treatment is preferably performed in air atmosphere or an inert atmosphere at a temperature of 300–600° C. for 0.5–24 hours. If the temperature is below 300° C., the pressing oil adhering to the chips is not completely burnt; what is more, the moisture that has been absorbed during storage is not fully dried and if the melting step is subsequently initiated by rapid temperature elevation, the moisture is decomposed to evolve hydrogen gas which is taken up by the melt to generate blow holes.

If the melting is done at a temperature higher than 600° C., oxidation proceeds so rapidly as to induce dross formation. If dross forms, the melt becomes viscous and the efficiency of the casting operation decreases. Therefore, the temperature for the preliminary heat treatment of the copper alloy to be melted is specified to lie between 300 and 600° C. If this heat treatment lasts for less than 0.5 hours, combustion of the pressing oil and drying of the moisture are accomplished only incompletely. If the time of the heat treatment is longer than 24 hours, the parent metal Cu diffuses in the Sn surface coat, where it oxidizes to form a Cu—Sn—O system oxide that is not only a dross former but also an economic bottleneck. Therefore, the time of the preliminary heat treatment of the copper alloy is specified to lie between 0.5 and 24 hours. The preliminary heat treatment will bring about satisfactory results if it is performed in air atmosphere but providing an inert gas seal is preferred for the purpose of preventing oxidation. However, some disadvantage will result from the use of a reducing gas since at elevated temperature, the moisture decomposes to evolve hydrogen gas that is taken up by the melt to diffuse in it.

After melting the copper alloy, it is desirably cast by the continuous process which may be either vertical or horizontal, except that the melt is cooled from the liquidus line to 600° C. at a rate of at least 50° C./min. If the cooling rate is less than 50° C./min, segregation of Zn and Sn occurs at grain boundaries and the efficiency of the subsequent hot working step decreases to lower the yield. The temperature range over which the cooling rate should be held not lower than 50° C./min may be between the liquidus line and 600° C. There is no sense of controlling the cooling rate at temperatures higher than the liquidus line; below 600° C., the duration of cooling in the casting process is insufficient to cause excess segregation of Zn and Sn at grain boundaries.

After casting the melt into an ingot, hot rolling is performed under heating at a temperature not higher than 900° C. Above 900° C., intergranular segregation of Zn and Sn causes hot cracking which, in turn, leads to a lower yield. By performing hot rolling at temperatures of 900° C. and below, not only the microsegregations that occurred during the casting step but also the cast structure will disappear and the resulting rolled strip has a homogeneous structure even if it contains Zn and Sn in the amounts defined for the copper alloy according to the first aspect of the invention. Preferably, hot rolling is performed at a temperature of 870° C. or below. The crystal grains in the hot rolled strip are desirably sized to 35 μm or less. If the crystal grain size exceeds 35 μm, the latitude in control over the reduction ratio for the subsequent cold rolling and the conditions for the annealing that follow is so small that the slightest departure may potentially produce mixed crystal grains, leading to deteriorated characteristics.

After hot rolling, the surface of the strip may be planed as required. Subsequently, cold rolling and annealing in the temperature range of 300–650° C. are repeated until the crystals in the as-annealed material have a grain size of no more than 25 μm. Below 300° C., it takes an uneconomically prolonged time to control the crystal grains; above 650° C., the crystal grains become coarse in a short time. If the size of the crystal grains in the as-annealed material exceeds 25 μm, mechanical characteristics, in particular 0.2% yield strength, or workability deteriorates. Preferably, the crystal grain size is reduced to 15 μm or below, more preferably 10 μm or below.

The thus annealed material is subjected to cold rolling for a reduction ratio of at least 30% and cold annealing at 450° C. or below so as to produce a copper alloy that has a 0.2% yield strength of at least 600 N/mm$^2$, a tensile strength of at least 650 N/mm$^2$, a Young's modulus of no more than 120 kN/mm$^2$, an electrical conductivity of at least 20% IACS and a percent stress relaxation of no more than 20% in the direction where said alloy was wrought whereas it has a 0.2% yield strength of at least 650 N/mm$^2$, a tensile strength of at least 700 N/mm$^2$ and a Young's modulus of no more than 130 kN/mm$^2$ in a direction perpendicular to said first direction. If the reduction ratio in cold rolling is less than 30%, the improvement in strength that is achieved by work hardening is insufficient to achieve the desired improvement in mechanical characteristics. The reduction ratio is preferably at least 60%. Low-temperature annealing is necessary to improve 0.2% yield strength, tensile strength, spring limit value and anti-stress relaxation characteristics. Beyond 450° C., so large a heat capacity is applied that the work softens in a short time. Another difficulty is that variations in the characteristics of the work are prone to occur in both a batch and a continuous system. Hence, cold annealing should be performed at temperatures not higher than 450° C.

The thus obtained material may optionally be subjected to surface treatments to provide a Cu undercoat 0.3–2.0 $\mu$m thick and a Sn surface film 0.5–5.0 $\mu$m thick before it is put to service. If the Cu undercoat is thinner than 0.3 $\mu$m, it is by no means effective in preventing the Zn in the alloy from diffusing into the Sn surface coat and to the surface where it is oxidized to increase contact resistance while reducing solderability. If the Cu undercoat is thicker than 2.0 $\mu$m, its effect is saturated and there is no economic advantage. The Cu undercoat need not be solely made of pure copper but may be composed of a copper alloy such as Cu—Fe or Cu—Ni.

If the Sn surface coat is thinner than 0.5 $\mu$m, the desired resistance to corrosion, particularly to hydrogen sulfide, is not obtained. If the Sn surface coat is thicker than 5.0 $\mu$m, its effect is saturated and an economic disadvantage will simply result. To secure uniformity in film thickness and economy, the surface treatments for providing the Cu undercoat and the Sn surface coat are preferably performed by electroplating. The Sn surface coat may be reflowed to improve its gloss. This treatment is also effective as a means of preventing Sn whiskers.

The thus treated material is pressed into electric terminals, which may subsequently be heat treated at a temperature of 100–280° C. for a duration of 1–180 minutes. This heat treatment is not only effective for improving on the spring limit value and anti-stress relaxation characteristics that have deteriorated as the result of press working but also instrumental to the prevention of whiskers. Below 100° C., these effects of the heat treatment are not fully attained; above 280° C., diffusion and subsequent oxidation not only increase the contact resistance but also lower the solderability and workability. If the duration of the heat treatment is shorter than 1 minute, its effects are not fully attained; if it continues longer than 180 minutes, diffusion and subsequent oxidation bring about the unwanted results just mentioned above and, in addition, there is no economic advantage.

The following examples are provided for the purpose of further illustrating the present invention but are in no way to be taken as limiting.

EXAMPLE 1

Copper alloy sample Nos. 1–6 having the compositions (wt %) shown in Table 1 were melted at temperatures 70° C. higher than their liquidus lines, fed into a small vertical continuous casting machine and cast into ingots measuring 30×70×1000 (mm). The rate of cooling from the liquidus line to 600° C. was adjusted to be in great excess of 50° C./min by controlling the primary cooling with the mold and the secondary cooling with a shower of water.

The ingots were heated to 800–840° C., hot rolled to a thickness of 5 mm and checked for surface or edge cracks to evaluate their hot workability. The samples are rated ○ if no cracks are found under examination with an optical microscope (×50) after pickling; otherwise, rating X is given. Hot rolling was allowed to end at about 600° C. and by subsequent quenching, the size of the crystal grains in the as-rolled ingot was controlled to about 30 $\mu$m. The ingots were then cold rolled to a thickness of 1 mm and annealed at temperatures of 450–520° C. so that the crystal grain size was adjusted to about 10 $\mu$m. After pickling, the ingots were cold rolled to a thickness of 0.25 mm and low-temperature annealed at 230° C. in the final step.

From each of thus produced strips, test pieces were sampled and measured for 0.2% yield strength, tensile strength, Young's modulus, electrical conductivity, percent stress relaxation and stress corrosion cracking life. The first three parameters were measured by the test methods described in JIS Z2241, provided that small (70 mm long) test pieces were used for measurements in a direction perpendicular to the rolling direction. Electrical conductivity was measured by the method described in JIS H0505. In the stress relaxation test, a bending stress representing 80% of the 0.2% yield strength was applied to the surface of each sample, which was held at 150° C. for 500 hours to measure the amount of bend. The percent stress relaxation was calculated by the following equation (3):

$$\text{Stress relaxation } (\%)=[(L1-L2)/(L1-L0)]\times 100 \quad (3)$$

where L0: length (mm) of the jig

L1: initial length (mm) of a sample

L2: horizontal distance (mm) between ends of the bent sample

In the stress corrosion cracking test, a bending stress representing 80% of the 0.2% yield strength was applied to the surface of each sample, which was exposed and held in a desiccator containing 12.5% aqueous ammonia. The exposure time was increased to 150 minutes at increments of minutes. The test pieces were exposed for the specified periods, taken out of the desiccator, optionally stripped of the surface coat by pickling, and checked for cracks by examination under an optical microscope (×100). The point in time minutes before any crack was observed was designated the "stress corrosion cracking life".

The results of measurements are shown in Table 1.

COMPARATIVE EXAMPLE 1

Comparative copper alloy sample Nos. 7–11 having compositions outside the invention ranges shown in Table 1 were cast and worked under the same conditions as in Example 1 to produce strips. From each of the strips, test pieces were sampled and measured for their mechanical properties, electrical conductivity and other characteristics by the same methods as in Example 1. The results are also shown in Table 1

TABLE 1

| Sample No. | Composition (wt %) Zn | Sn | Value of eq. 1 | Others | S (ppm) | 0.2% yield strength ($N/mm^2$) Rolling direction / Perpendicular direction | Tensile strength ($N/mm^2$) Rolling direction / Perpendicular direction | Young's modulus ($kN/mm^2$) Rolling direction / Perpendicular direction | Electrical conductivity (% IACS) | Hot workability | Stress relaxation (%) | Stress corrosion cracking life (min) |
|---|---|---|---|---|---|---|---|---|---|---|---|---|
| | | | | | | Example 1 | | | | | | |
| 1 | 24.7 | 0.84 | 7.0 | — | 13 | 755<br>822 | 812<br>932 | 108<br>117 | 24.9 | ○ | 12.6 | 120 |
| 2 | 26.1 | 0.71 | 7.2 | — | 12 | 756<br>829 | 818<br>930 | 109<br>118 | 25.3 | ○ | 10.8 | 110 |
| 3 | 25.0 | 0.91 | 7.2 | Ni 0.18 | 12 | 763<br>840 | 831<br>951 | 110<br>118 | 22.9 | ○ | 10.8 | 120 |
| 4 | 25.4 | 0.69 | 7.0 | Fe 0.12<br>Cr 0.07 | 12 | 731<br>819 | 811<br>930 | 107<br>118 | 26.1 | ○ | 12.0 | 110 |
| 5 | 24.2 | 1.10 | 7.2 | Si 0.19<br>Ti 0.05 | 12 | 770<br>838 | 835<br>950 | 106<br>117 | 22.2 | ○ | 12.5 | 110 |
| 6 | 23.6 | 0.91 | 6.8 | Al 0.29<br>Mn 0.31 | 14 | 750<br>818 | 811<br>916 | 108<br>117 | 23.8 | ○ | 12.1 | 110 |
| | | | | | | Comparative Example 1 | | | | | | |
| 7 | 24.5 | 0.19 | 6.3 | — | 13 | 673<br>699 | 714<br>802 | 118<br>124 | 26.9 | ○ | 16.9 | 100 |
| 8 | 27.5 | 1.72 | 8.6 | — | 12 | 771<br>860 | 840<br>955 | 109<br>117 | 21.5 | X | 12.1 | 110 |
| 9 | 21.1 | 0.44 | 5.7 | — | 13 | 671<br>713 | 725<br>822 | 108<br>119 | 27.4 | ○ | 20.1 | 120 |
| 10 | 27.5 | 1.18 | 8.1 | — | 41 | — | — | — | — | X | — | |
| 11 | 30.2 | 0.22 | 7.8 | Ni 0.13 | 14 | 682<br>711 | 741<br>828 | 109<br>119 | 24.4 | ○ | 22.7 | 40 |

As can be seen from Table 1, copper alloy sample Nos. 1–6 according to the present invention had good enough hot workability to allow for efficient strip manufacture, exhibited good balance between 0.2% yield strength, tensile strength, Young's modulus and electrical conductivity, and featured satisfactory anti-stress relaxation characteristics and high resistance to stress corrosion cracking. Hence, these copper alloy samples had excellent characteristics that made them particularly suitable for use as materials to be shaped into connectors and other electrical or electronic parts.

On the other hand, comparative alloy sample No. 7 having an unduly small Sn content and comparative sample No. 9 having an unduly small Zn content were inferior in 0.2% yield strength, tensile strength and anti-stress relaxation characteristics. Comparative sample No. 7 was also inferior in Young's modulus: Comparative sample No. 8 which contained Zn and Sn in the specified amounts but which exceeded the upper limit of eq. (1) was inferior in hot workability and suffered the problem of cost increase due to lower yield. Comparative sample No. satisfied the conditions of Zn and Sn contents and eq. (1) but it contained an excessive amount of S as an impurity; therefore, cracks developed during hot working and even by application of subsequent cold working, the alloy could not be reduced to the final strip thickness in high yield. Comparative sample No. 11 having an excessive Zn content but an unduly small Sn content was inferior in anti-stress relaxation characteristics and resistance to stress corrosion cracking.

COMPARATIVE EXAMPLE 2

Commercial samples of class 1 brass (C26000-H08) and spring phosphor bronze (C52100-H08) were cast and worked as in Example 1 to produce strips. From each of these strips, test pieces were sampled and measured for 0.2% yield strength, tensile strength, Young's modulus, electrical conductivity, percent stress relaxation and stress corrosion cracking life by the same methods as in Example 1. The commercial samples used in this comparative example had the temper grade H08 (spring) which was of higher strength than any other grades of the same composition.

The results are shown in Table 2 together with the result for sample No. 1 of the invention that is quoted from Table 1. Data on hardness (HV) is also shown in Table 2.

TABLE 2

| | Composition (wt %) | | | 0.2% yield strength ($N/mm^2$) Rolling direction Perpendicular | Tensile strength ($N/mm^2$) Rolling direction Perpendicular | Young's modulus ($kN/mm^2$) Rolling direction Perpendicular | Electical conductivity | Hardness | Stress Relaxation | Stress corrosion cracking life |
|---|---|---|---|---|---|---|---|---|---|---|
| | Zn | Sn | Others | direction | direction | direction | (% IACS) | (HV) | (%) | (min) |
| Sample No. 1 | 24.7 | 0.84 | — | 755 | 812 | 108 | 24.9 | 232 | 12.6 | 120 |
| in Example 1 | | | | 822 | 932 | 117 | | | | |
| Comparative | 29.8 | — | — | 641 | 672 | 112 | 27.2 | 204 | 48.9 | 20 |
| Example 2 | | | | 715 | 791 | 119 | | | | |
| Comparative | — | 8.11 | P 0.19 | 725 | 784 | 116 | 12.8 | 228 | 13.0 | — |
| Example 2 | | | | 808 | 911 | 128 | | | | |

As one can see from Table 2, the copper alloy of the invention is improved, particularly in terms of 0.2% yield strength, tensile strength, anti-stress relaxation characteristics and resistance to stress corrosion cracking, as compared with brass which is a representative material for electrical or electronic components such as connectors. It is also superior to spring phosphor bronze in terms of Young's modulus and electrical conductivity. Spring phosphor bronze contains as much as 8% of expensive tin and its materials cost is liable to frequent increases. In addition, being not amenable to hot rolling, spring phosphor bronze can be produced by only limited methods and it is less advantageous in terms of total cost including production cost.

Therefore, one may safely conclude that the copper alloy of the invention has practical superiority over the existing brass and phosphor bronze series.

EXAMPLE 2

Copper alloy sample No. 12 of the composition Cu-25.1Zn-0.82Sn (wt %) which was within the scope of the invention was subject to continuous casting under varying conditions for primary and secondary cooling at varied drawing speeds. The cooling rate was measured with thermocouples which were eventually cast into ingots. The alloy had a liquidus line of about 950° C. and the average rate of cooling from this temperature to 600° C. was measured.

The ingots were subsequently heated to 840° C. and subjected to 9 passes of hot rolling for a reduction ratio of about 15% per pass; the hot rolled sheet metals were checked for surface and edge cracks by microscopic examination. The sheet metals from the ingots cast at average cooling rates of 50° C./min and above experienced no cracking at all during hot rolling. In particular, the sheet metals from the ingots cast at average cooling rates of 80° C./min and above had a greater latitude in the conditions for hot rolling in terms of both temperature and reduction ratio. On the other hand, the sheet metals from the ingots cast at cooling rates slower than 50° C./min experienced cracking during hot rolling; it was therefore clear that even if the alloy composition is within the scope of the invention, cracking may develop during hot rolling if the average cooling rate in the casting process is not appropriate, with the occasional decrease in yield.

EXAMPLE 3

Sample No. 1 prepared in Example 1 was plated with a 0.45-$\mu$m thick Cu undercoat and a 1.2-$\mu$m thick reflowed Sn coat. The alloy was worked into a spring-loaded female terminal in box shape and heat treated at 190° C. for 60 minutes. This terminal and a non-heat treated terminal of the same sample were each fitted with a male terminal and the assemblies were exposed and held in a thermostatic vessel at 125° C. for 330 hours. The low-voltage low-current resistance and contact load were measured both at the initial stage and after exposure in the thermostatic vessel. The results are shown in Table 3.

TABLE 3

| | Low-voltage low current resistance (mΩ) | | Contact load (N) | |
|---|---|---|---|---|
| | Initial | After exposure | Initial | After exposure |
| With heat treatment | 1.90 | 5.33 | 7.88 | 7.11 |
| Without heat treatment as-pressed | 1.79 | 6.87 | 7.69 | 5.92 |

As can be seen from Table 3, heat treatment of press-formed terminals is effective for preventing the increase in low-voltage low-current resistance and the decrease in contact load that would otherwise occur after standing at high temperature. This contributes to improving the reliability of terminals made from the copper alloy according to the first aspect of the invention which is produced by the manufacturing process according to its second aspect.

EXAMPLE 4

Strips were fabricated from sample No. 1 of the invention and comparative sample Nos. 7 and 11. The strips were then shaped into sawtoothed terminals (tooth-to-tooth pitch: 1.25 mm) by punching on a press using a superhard punch and a die made of tool steel. The clearance was adjusted to 8% of the strip thickness.

After $10^6$ shots of punching operation, the development of burrs was evaluated by examining the punched surfaces in both the rolling direction and the direction perpendicular to it with an optical microscope. The terminals made from sample No. 1 had no burrs higher than 10 $\mu$m; on the other hand, the terminals made from comparative sample Nos. 7 and 11 had burrs higher than 20 $\mu$m, particularly in areas parallel to the rolling direction.

Thus, it can be seen that alloy sample No. 1 of the invention is also advantageous for preventing mold wear.

As is clear from the foregoing description, the copper alloy according to the first aspect of the invention is superior to the conventional brasses and phosphor bronzes in terms of not only the balance between 0.2% yield strength, tensile strength, electrical conductivity and Young's modulus but also anti-stress relaxation characteristics and resistance to stress corrosion cracking, as well as press formability. What is more, the alloy can be produced at low cost by the process according to the second aspect of the invention. Hence, it is an optimum alternative to brasses and phosphor bronzes as a material for connectors and other electrical or electronic components.

EXAMPLE 5

An alloy X, which is believed to be an equivalent of Alloy C as set forth in Table 3 in column 10 of Reference A (U.S. Pat. No. 6,132,528 to Brauer et al.), was prepared by the method as described in column 6, line 66 through column 7, line 58 of Reference A. In particular, the copper alloy containing 10.1 wt % zinc, 2.2 wt % iron, 1.8 wt % tin, 0.06 wt % phosphorus (Cu-10.1 Zn-2.2 Fe-1.8 Sn-0.06 P) and the balance copper was prepared by casting to an alloy ingot. The ingot was cut off so that an alloy plate 20 mm thick was obtained. The plate was hot rolled at a temperature of 850° C. until an alloy sheet 4 mm thick was obtained (the hot rolling reduction was 80%). After hot rolling, the alloy sheet was water quenched from a temperature of 650° C. or higher. The quenched sheet was then mechanically milled to remove surface oxides and then cold rolled to a strip 1.5 mm thick (reduction of 63%). The strip was then subjected to aging treatment at a temperature of 550° C. for a time of 4 hours. The alloy strip was pickled and ,after pickling, the strip was cold rolled to a thickness of 0.5 mm (reduction of 67%) and then was subjected to recrystallization treatment at 500° C. for 3 hours. By this treatment the crystal grain size of the alloy was controlled to an average grain size of approximately 10 $\mu$m. The alloy strip was then cold rolled to a thickness of 0.15 mm (reduction of 70%), and finally the strip was subjected to a low temperature anneal at 250° C. for 2 hours.

From the strip of the alloy X produced by the method mentioned above, test pieces were sampled and measured for Young's modulus, 0.2% yield strength, tensile strength and electrical conductivity. Young's modulus, 0.2% yield strength and tensile strength were measured by the test methods described in JIS Z 2241. Electrical conductivity was measured by the test method described in JIS H0505. Measurements for Sample No. 1 in Example 1 of the present application are also listed in the following Table A for the purpose of comparison. Numerical values in parentheses given in columns of 0.2% yield strength and tensile strength are the values in the unit of ksi converted from the values in the unit of N/mm$^2$.

As explained above in detail the alloy X, as an equivalent of the alloy C as set forth in Table 3 in Reference A, was prepared in accordance with the method disclosed in Reference A. The results of measurements of characteristic properties of the equivalent alloy are in good agreement with those of the alloy C disclosed in Reference A. In more particular, the alloy X prepared by this additional experiment was confirmed to be almost the same with the alloy C of Reference A with respect to the measurements of 0.2% yield strength, tensile strength and electrical conductivity. Accordingly, it is believed that the method by which the alloy X was prepared correctly reproduced the method of Reference A by employing the same process steps as those of the method of Reference A and including the same structure-controlling procedures such as controlling the formation of Fe—P precipitates, etc. Thus, it is believed that the alloy X is substantially the same as the alloy C disclosed in Reference A.

Now, we wish to focus our attention on the value of Young's modulus. The alloy of Reference A cannot satisfy the requirement that Young's modulus should be less than 120 kN/mm$^2$. This is considered to be attributable to the formation of Fe—P system precipitate or Fe-precipitate resulting from the presence of a large amount of Fe and the effect of P.

In contrast, the alloy of the present application (Sample No. 1) not only exhibits at least the same level of numerical values as those of the alloys of Reference A in each of 0.2% yield strength, tensile strength and electrical conductivity but also satisfies the requirement of Young's modulus of not more than 120 kN/mm$^2$. This is due to the close limitation with respect to the amounts of Zn and Sn.

Comparing with the alloy of Reference A, the alloy of the present invention contains a larger amount of Zn which is an inexpensive element and a smaller amount of Sn which is an expensive element. This is advantageous from a viewpoint of raw material costs. Further it is extremely advantageous from a view point of total cost reduction because in the practice of the present invention no complicated heat treating steps for obtaining precipitates such as Fe—P is required as in the case of Reference A.

EXAMPLE 6

An alloy Y, which is believed to be an equivalent of Alloy C312 as set forth in Table 1 given in column 4 of Reference B (U.S. Pat. No. 4,205,984 to Smith, Jr. et al.) was prepared in accordance with the method described in columns 2 and 3 of Reference B. In particular, a copper alloy containing 27.2 wt % zinc, 0.42 wt % silicon, 0.31 wt % tin and the balance copper (Cu-27.2Zn-0.42Si-0.31Sn) was prepared by

TABLE A

| | Composition (wt %) | | | | Young's modulus | 0.2% yield strength | Tensile strength | Electrical conductivity |
|---|---|---|---|---|---|---|---|---|
| | Zn | Fe | Sn | P | (kN/mm$^2$) | (N/mm$^2$) | (N/mm$^2$) | (% IACS) |
| Alloy X (an equivalent of Alloy C of Reference A) | 10.1 | 2.2 | 1.8 | 0.06 | 130 | 718 (103) | 769 (110) | 24.6 |
| Sample No. 1 in Example 1 of the Present Application | 24.7 | — | 0.84 | — | 108 | 755 | 812 | 24.9 |

casting to an alloy ingot. The ingot was cut off so that an alloy plate 20 mm thick was obtained. The plate was hot rolled at a temperature of 800° C. until an alloy sheet 4 mm thick was obtained (hot rolling reduction was 80%). After hot rolling the alloy sheet was water quenched. The quenched sheet was then mechanically milled to remove surface oxide and then cold rolled to obtain a strip 1.5 mm thick (reduction of 63%). The strip was then subjected to heat treatment at a temperature of 550° C. for a time of 1 hour. The alloy strip was pickled and then was cold rolled to a thickness of 0.5 mm (reduction of 67%). Then, the strip was subjected to recrystallization treatment at a temperature of 450° C. for a time of 3 hours. By this treatment the crystal grain size of the alloy was controlled to an average size of approximately 10 $\mu$mm. The alloy strip was then cold rolled to a thickness of 0.2 mm (reduction of 60%), and was finished by finally subjecting to degrease-cleaning treatment.

From the strip of the alloy Y produced by the method mentioned above, test pieces were sampled and measured for Young's modulus, 0.2% yield strength, tensile strength and electrical conductivity. Young's modulus, 0.2% yield strength and tensile strength were measured in the same manner as described in the working examples given in the present application, namely, in accordance with the test methods described in JIS Z 2241. Electrical conductivity was measured in accordance with the test method described in JIS H0505. Measurements for Sample No. 1 in Example 1 of the present application are also listed in the following Table B for the purpose of comparison. Numerical values in parentheses given in columns of 0.2% yield strength and tensile strength are the values in the unit of ksi converted from the values in the unit of N/mm$^2$.

TABLE B

| | Composition (wt %) | | | Young's modulus | 0.2% yield strength | Tensile strength | Electrical conductivity |
|---|---|---|---|---|---|---|---|
| | Zn | Si | Sn | (kN/mm$^2$) | (N/mm$^2$) | (N/mm$^2$) | (% IACS) |
| Alloy Y (an equivalent of Alloy C312 of Reference B | 27.2 | 0.42 | 0.31 | 124 | 645 (92.1) | 763 (109.0) | 21.5 |
| Sample No. 1 in Example 1 of the Present Application | 24.7 | — | 0.84 | 108 | 755 | 812 | 24.9 |

As explained above in detail the alloy Y, as an equivalent of the alloy C312 as set forth in Table 1 in Reference B, was prepared in accordance with the method disclosed in Reference B. The results of measurements of characteristic properties of the equivalent alloy (the alloy Y) are in good agreement with those of the alloy C312 disclosed in Reference B. In more particular, the alloy Y prepared by this additional experiment was confirmed to be almost the same as the alloy C312 of Reference B with respect to the measurements of 0.2% yield strength, tensile strength and electrical conductivity. Accordingly, it is believed that the method by which the alloy Y was prepared correctly reproduced the method of Reference B by employing the same process steps as those of the method of Reference B and including the same structure-controlling procedures. Thus, it is believed that the alloy Y is substantially the same as the alloy C312 disclosed in Reference B.

Now, we wish to focus our attention on the value of Young's modulus. The alloy of Reference B cannot satisfy the requirement that Young's modulus should be not more than 120 kN/mm$^2$. This is considered to be attributable to the presence of Si and to the effect of interaction of Si and Sn.

In contrast, the alloy of the present application (Sample No. 1) not only exhibits at least the same level of numerical values as those of the alloys of Reference B in each of 0.2% yield strength, tensile strength and electrical conductivity but also satisfies the requirement of Young's modulus of not more than 120 kN/mm$^2$. This is due to the use of extremely limited amounts of Zn and Sn according to the present invention.

The present invention is believed to be novel at least in the aspect that the alloy is free from Si which is an essential element for the alloys of Reference B and yet it has attained to develop the desired characteristic properties based on the basic composition of Cu—Zn—Sn system alloy. Also from a viewpoint of production costs the alloys of Reference B will be more disadvantageous than the present invention because of the necessity of an addition of Si. Moreover, the present invention is more advantageous than Reference B from a viewpoint of total cost reduction because there is no need to closely control the operational conditions within the given narrow range to maintain the optimal Si content.

EXAMPLE 7

The object of this experiment is to prove the clear difference between the present invention and that of Reference O taken as a representative of References O, P and Q that disclose similar or substantially the same inventions, respectively.

Table 1 in the Working Example of Reference O (JP 62227071) discloses a number of copper base alloys including the following two alloys:

Sample No. 8: Cu-27 Zn-6 Ni-4 Mn-0.6 Sn;

Sample No. 15: Cu-27 Zn-9 Ni- Mn-1.7 Sn-0.1 Co-0.03 Cd;

The alloys Z and R which are believed to be substantially equivalent to the above mentioned alloys No. 8 and alloy No. 15, respectively, were prepared by casting in accordance with the method disclosed in Reference O.

Alloy Z: Cu-27.1 Zn-6.2 Ni-3.9 Mn-0.58 Sn;

Alloy R: Cu-27.4 Zn-8.8 Ni-10.2 Mn-1.72 Sn-0.11 Co-0.03 Cd;

Since in Reference O process conditions are disclosed only for hot rolling and low temperature annealing the other process conditions such as those for "hot workings" were properly and arbitrarily determined by the supervisor. Actual process steps were as given below.

Each of the cast ingots having the compositions shown above was cut into a plate 20 mm thick and then the plate was hot rolled at a temperature of 850° C. until it became a sheet 4 mm thick (reduction of 80%). Then the sheet was water quenched and the quenched sheet was mechanically milled to remove surface oxides before it was cold rolled into a strip 1.5 mm thick. (reduction of 63% ). The strip was then subjected to heat treatment at 600° C. for 1 hour. Then the strip was pickled and subsequently was cold rolled to a thickness of 0.5 mm (reduction of 67%) and then was subjected to recrystallization treatment at 550° C. for 3 hours. By this treatment the crystal grain size of the alloy was controlled to a grain size of approximately 10 $\mu$m. The strip was again cold rolled to a thickness of 0.2 mm (reduction of 60%) and finally, in accordance with the process conditions as set forth in Table 1 in Example 1 of Reference O, the alloy Z (an equivalent of Sample No. 8) was subjected to low temperature annealing at 200° C. for 3 hours and the alloy R (an equivalent of Sample N. 15) was subjected to low temperature annealing at 250° C. for 3 hours to finish the entire treatment.

From the strip of each of the alloys Z and R produced by the method mentioned above, test pieces were sampled and measured for Young's modulus, tensile strength and electrical conductivity. Young's modulus and tensile strength were measured, as shown in the working example in the present application, in accordance with JIS Z 2241 and electrical conductivity were measured by the methods as described in JIS-H-0505. Measurements for Sample No. 1 in Example 1 of the present application are listed in the following Table C for the purpose of comparison. Values in parentheses given in column of tensile strength are those given in the unit of ksi converted from the values given in the unit of N/mm$^2$.

TABLE C

| | Composition | Young's modulus kN/mm$^2$ | Tensile Strength KN/mm$^2$ | Electrical Conductivity % IACS |
|---|---|---|---|---|
| Alloy Z (an equivalent of Sample No. 8 of Reference O) | Cu- 27.1 Zn- 6.2 Ni- 3.9 Mn- 0.58 Sn | 137 | 840 (86) | 9.8 |
| Alloy R (an equivalent of Sample No. 15 of Reference O) | 27.4 Zn- 8.8 Ni- 10.2 Mn- 1.72 Sn- 0.11 Co- 0.03 Cd | 139 | 921 (89) | 7.2 |
| Sample No. 1 in Example 1 of Present Application | 24.7 Zn- 0.84 Sn | 108 | 812 | 24.9 |

Alloys Z and R, as equivalents of Sample Nos. 8 and 15, respectively, disclosed in Reference O were prepared by the method in accordance with the teaching given in Reference O. The characteristic properties of these alloys were well agreed with those of the corresponding alloys disclosed in Reference O. Accordingly, the sample alloys Z and R produced by trial are considered to be substantially the same as the alloys of Sample Nos. 8 and disclosed in Reference O, respectively.

It is the values of Young's modulus that we wish to draw attention of the Examiner. The alloys of Reference O are slightly superior to the alloys of the present invention in the aspect of tensile strength. The values of Young's modulus, however, are much larger than 120 kN/mm$^2$ with respect to the alloys of Reference O. In addition, values of electrical conductivity of the alloys of Reference O are much lower than the values required for connector materials. This seems to be attributable to the presence of a large amount of Ni and Mn contained in the alloys in solid-solution form. The presence of a large amount of Ni and Mn in such a state is effective for the improvement of strength of alloys. However, the desired values will not be fulfilled with respect to Young's modulus and electrical conductivity. Even if the interaction between Ni and Mn or between Ni and S plays an important role such as spinodal decomposition, electrical conductivity is too low to be acceptable.

In contrast, the alloy of Sample No. 1 of the present invention is not only superior in electrical conductivity but also satisfies the requirement of Young's modulus being not greater than 120 kN/mm$^2$. This is attributable to the use of extremely limited amount of Zn and Sn.

The novelty of the present invention is believed to consist in that no such a large amount of Ni and Mn as shown in References O, P and Q is used as in the cases of References O, P and Q but the alloy of Cu—Zn—Sn system has been improved without so much changing its fundamental structure. Also from a viewpoint of production cost, the alloys disclosed in References O, P and Q are disadvantageous as compared with the alloys of the present invention because of their containing a large amount of expensive Ni and Mn. Furthermore, in the case of the prior art alloys, permissible condition range in the production of goods is narrower than in the case of the present invention and accordingly, the alloys of the present invention are more advantageous from a viewpoint of total coat reduction, too.

As is obvious from the above description the alloys of the present application are superior to the prior art alloys at least in satisfying the requirement for Young's modulus, while exhibiting strength and electrical conductivity at least comparable to those of the prior art alloys.

Thus, novelty consists in that all of the above mentioned advantages of the alloys of the present invention have been attained by using the alloys of Cu—Zn—Sn system in their basic form.

What is claimed is:

1. A connector copper alloy consisting essentially of 23–28 wt % Zn and 0.6–1.4 wt % Sn and optionally 0.01 to 0.6 wt % in total of at least one element selected from the group consisting of Ni, Co, Ti, Mg, Zr, Ca, Mn, Cd, Al, Pb, Bi, Be, Te, Y, La, Cr, Ce, Au and Ag with the balance being Cu and incidental impurities, provided that S is not present in an amount of greater than 30 ppm, and which satisfies the following relationship (1):

$$6.4 \leqq 0.25X+Y \leqq 8.0 \quad (1)$$

where X is the amount of Zn in wt % and Y is the amount of Sn in wt %, said alloy having a 0.2% yield strength of at least 600 N/mm$^2$, a tensile strength of at least 650 N/mm$^2$, an electrical conductivity of at least 20% IACS, a Young's modulus of no more than 120 kN/mm$^2$ and a percent stress relaxation of no more than 20%.

2. A connector copper alloy consisting essentially of 23–28 wt % Zn and 0.6–1.4 wt % Sn with the balance being Cu and incidental impurities, provided that S is not present in an amount greater than 30 ppm and which satisfies the following relationship (1):

$$6.4 \leqq 0.25X+Y \leqq 8.0 \quad (1)$$

where X is the amount of Zn in wt % and Y is the amount of Sn in wt %, said alloy having a 0.2% yield strength of at least 600 N/mm$^2$, a tensile strength of at least 650 N/mm$^2$, a Young's modulus of no more than 120 kN/mm$^2$, an electrical conductivity of at least 20% IACS and a percent stress relaxation of no more than 20% in a first direction where said alloy is wrought and having a 0.2% yield strength of at least 650 N/mm$^2$, a tensile strength of at least 700 N/mm$^2$ and a Young's modulus of no more than 130 kN/mm$^2$ in a direction perpendicular to said first direction.

3. The connector copper alloy according to claim 1 or 2, which contains 0.01 to 0.6 wt % in total of at least one element selected from the group consisting of 0.01 to 0.6 wt % Ni, 0.01 to 0.6 wt % Co, 0.01 to 0.6 wt % Ti, 0.01 to 0.6 wt % Mg, 0.01 to 0.6 wt % Zr, 0.01 to 0.6 wt % Ca, 0.01 to 0.6 wt % Cd, 0.01 to 0.6 wt % Al, 0.01 to 0.6 wt % Pb, 0.01 to 0.6 wt % Bi, 0.01 to 0.6 wt % Be, 0.01 to 0.6 wt % Te, 0.01 to 0.6 wt % Y, 0.01 to 0.6 wt % La, 0.01 to 0.6 wt % Cr, 0.01 to 0.6 wt % Ce, 0.01 to 0.6 wt % Au and 0.01 to 0.6 wt % Ag.

4. The connector copper alloy according to claim 1, wherein the Zn is in an amount of 24 to 27 wt %.

5. The connector copper alloy according to claim 1, wherein the S is not present in an amount greater than 15 ppm.

6. The connector copper alloy according to claim 5, wherein the Zn is in an amount of 24 to 27 wt %.

7. The connector copper alloy according to claim 6, wherein the copper alloy consists essentially of Zn, Sn, Cu and incidental impurities.

8. The connector copper alloy according to claim 7, wherein the Zn is in an amount of 24.7 wt %.

9. The connector copper alloy according to claim 7, wherein the Zn is in an amount of 26.1 wt %.

10. A connector copper alloy consisting essentially of 23 to 28 wt % Zn and 0.3 to 1.4 wt % Sn and optionally 0.01 to 5 wt % of at least one element selected from the group consisting of 0.01 to 0.12 wt % Fe, 0.01 to 0.18 wt % Ni, 0.01 to 3 wt % Co, 0.01 to 3 wt % Ti, 0.01 to 2 wt % Mg, 0.01 to 2 wt % Zr, 0.01 to 1 wt % Ca, 0.01 to 0.31 wt % Mn, 0.02 to 3 wt % Cd, 0.01 to 5 wt % Al, 0.01 to 3 wt % Pb, 0.01 to 3 wt % Bi, 0.01 to 3 wt % Be, 0.01 to 1 wt % Te, 0.01 to 3 wt % Y, 0.01 to 3 wt % La, 0.01 to 3 wt % Cr, 0.01 to 3 wt % Ce, 0.01 to 5 wt % Au and 0.01 to 5 wt % Ag, with the balance being Cu and incidental impurities, provided that S is not present in an amount of greater than 30 ppm, and which satisfies the following relationship (1):

$$6.0 \leqq 0.25X+Y \leqq 8.5 \quad (1)$$

where X is the amount of Zn in wt % and Y is the amount of Sn in wt %, said alloy having a 0.2% yield strength of at least 600 N/mm$^2$, a tensile strength of at least 650 N/mm$^2$, an electrical conductivity of at least 20% IACS, a Young's modulus of no more than 120 kN/mm$^2$ and a percent stress relaxation of no more than 20%.

11. The connector copper alloy according to claim 10, wherein the copper alloy has a percent stress relaxation of no more than 20% in a first direction where said alloy is wrought and has a 0.2% yield strength of at least 650 N/mm$^2$, a tensile strength of at least 700 N/mm$^2$ and a Young's modulus of no more than 130 kN/mm$^2$ in a direction perpendicular to said first direction.

12. The connector copper alloy according to claim 10, wherein the Zn is in an amount of 24 to 27 wt %, the Sn is in an amount of 0.6 to 1.4 wt % and S is not present in an amount greater than 15 ppm.

13. The connector copper alloy according to claim 10, wherein the copper alloy consists essentially of 25 wt % Zn, 0.91 wt % Sn, 0.18 wt % Ni and the remainder being Cu and incidental impurities.

14. The connector copper alloy according to claim 10, wherein the copper alloy consists essentially of 25.4 wt % Zn, 0.69 wt % Sn, 0.12 wt % Fe, 0.7 wt % Cr and the remainder being Cu and incidental impurities.

15. The connector copper alloy according to claim 10, wherein the copper alloy consists essentially of 23.6 wt % Zn, 0.91 wt % Sn, 0.29 wt % Al, 0.31 wt % Mn and the remainder being Cu and incidental impurities.

* * * * *